US006953885B2

(12) United States Patent
Konishi

(10) Patent No.: US 6,953,885 B2
(45) Date of Patent: Oct. 11, 2005

(54) TUNING DEVICE

(75) Inventor: Hiroyuki Konishi, Chiba (JP)

(73) Assignee: Seiko Instruments Inc., Chiba (JP)

( * ) Notice: Subject to any disclaimer, the term of this patent is extended or adjusted under 35 U.S.C. 154(b) by 47 days.

(21) Appl. No.: 10/659,611

(22) Filed: Sep. 10, 2003

(65) Prior Publication Data

US 2004/0112200 A1 Jun. 17, 2004

(30) Foreign Application Priority Data

Sep. 13, 2002 (JP) ..... 2002-268087

(51) Int. Cl.[7] ..... G10G 7/02
(52) U.S. Cl. ..... 84/454; 84/455; 84/456
(58) Field of Search ..... 84/454, 455, 456

(56) References Cited

U.S. PATENT DOCUMENTS 3,896,697 A * 7/1975 Iannone ..... 84/454
4,081,764 A * 3/1978 Christmann et al. ..... 372/43
5,777,248 A * 7/1998 Campbell ..... 84/454
6,252,254 B1 * 6/2001 Soules et al. ..... 257/89
6,319,425 B1 * 11/2001 Tasaki et al. ..... 252/301.36

* cited by examiner

*Primary Examiner*—Shih-Yung Hsieh
(74) *Attorney, Agent, or Firm*—Adams & Wilks

(57) ABSTRACT

A tuning device measures and displays a deviation between a fundamental frequency of a music signal and a standard reference frequency. The tuning device has a meter having a graduated display and a movable needle, one or both of which are provided with a fluorescent substance. An LED emits energy effective to cause the fluorescent substance to emit light to illuminate the meter display thereby making it easy to tune a musical instrument in poorly lighted or dark locations. The fluorescent substance of the graduated display may emit light of the same or a different color from that emitted by the fluorescent substance of the needle indicator.

18 Claims, 1 Drawing Sheet

TUNING DEVICE

BACKGROUND OF THE INVENTION

1. Field of the Invention

The present invention relates to a tuning device for tuning a musical instrument, and in particular, to a display portion of the tuning device.

2. Description of the Related Art

Tuning devices for measuring a deviation between a fundamental frequency of a sound of a musical instrument, a music signal, or the like, and a reference frequency as a standard for comparison, which are provided with displaying means for displaying the deviation, are conventionally known (refer to JP 2000-243131 A, for example). Further, meters having a needle indicator portion and a graduated scale portion, devices having liquid crystal display elements, and the like, are known as the displaying means for the tuning device (refer to Japanese Utility Model Registration No. 3033255, for example).

When a meter having a needle indicator portion and a graduated scale portion is used, light from an LED employed as an illuminating means diffuses and lights up the needle indicator portion and the graduated scale portion. However, expression can only be made by light of a single color when performing tuning in a dark location with this type of conventional method. Further, there is a problem in that the behavior of the needle indicator is difficult to verify. Therefore, with conventional tuning devices, it is particularly difficult to satisfy the requirements for cases when quick and accurate tuning is sought in a dark location, such as on stage during a concert.

SUMMARY OF THE INVENTION

In view of those problems, an object of the present invention is to provide a tuning device with which it is possible to easily read a graduated scale of a display, and in which it is possible to easily verify the behavior of a needle indicator, even when tuning is performed in a dark location.

In order to achieve the aforementioned object, a tuning device of the present invention uses an LED as an illuminating means, the LED having energy that can cause a fluorescent coating to emit light. Further, the fluorescent coating is applied to a needle indicator portion or a graduated scale portion of the meter, or to both the needle indicator portion and the graduated scale portion of the meter, in the tuning device of the present invention. If the LED, which is disposed in the vicinity of the meter, illuminates the meter in the tuning device structured as described above, light from the LED itself lights up the meter. In addition, the energy of the LED can excite the fluorescent coating, and cause the fluorescent coating to emit light.

DETAILED DESCRIPTION OF THE PREFERRED EMBODIMENT

The preferred embodiments of the present invention are explained hereinafter with reference to the drawings.

Figure 1:
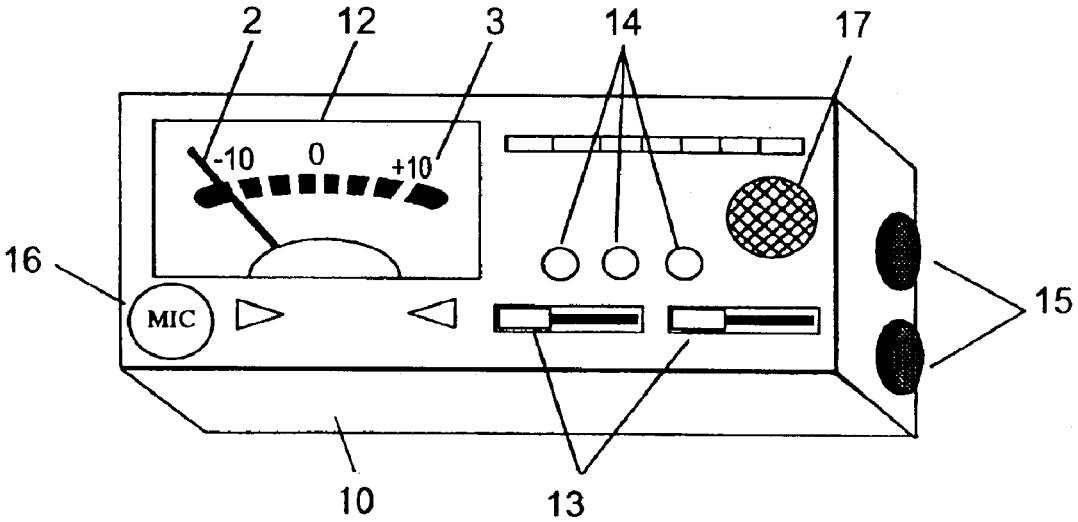
FIG. 1 is a front elevational view of an embodiment of a tuning device in accordance with the present invention.

FIG. 1 is a front elevational view of an embodiment of a tuning device in accordance with the present invention. In FIG. 1, a displaying means 12, an electric power source and mode setting switch 13, a pitch setting switch 14, an internal microphone 16 for picking up musical sounds, a speaker 17 for sound production of a selected reference tone, and the like are disposed in a front surface of a main body case 10. An input jack 15 for inputting musical sounds is provided in a main body side surface. The displaying means 12 has a needle indicator portion 2 and a graduated scale portion 3. The displaying means 12 is a meter that is enclosed in a case made of a transparent resin, or the like, in order to make visual verification possible. Each switch is a push type switch or a sliding type switch.

To use the tuning device, the electric power source and mode switch 13 of the tuning device is operated first, to turn on the tuning device. A user selects a tuning mode from manual or sound by selecting a position of the electric power source and mode switch 13. In addition, the user selects which sound to perform tuning on by using the pitch setting switch 14. When musical instrument sounds are input from the input jack or the internal microphone, a cent deviation between the selected sound and the input sound is displayed by the meter.

Figure 2:
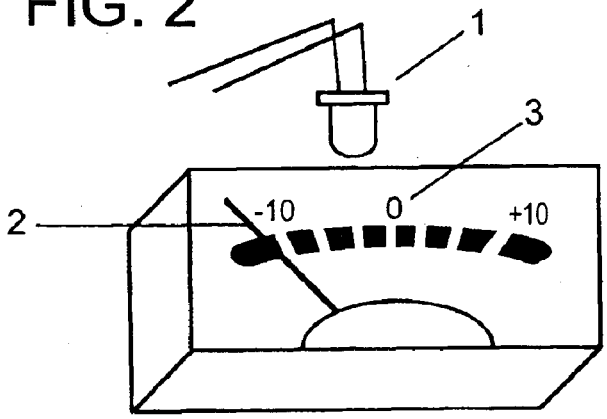
FIG. 2 is an embodiment of a meter of the tuning device of the present invention.

An embodiment of the meter of the tuning device of the present invention is shown next in FIG. 2.

In FIG. 2, an LED 1 used as an illuminating means is disposed in a portion above the center of the meter 12. The LED 1 has energy that is capable of causing a fluorescent substance to emit light. The LED 1 emits near ultraviolet rays in the embodiments of the present invention. The LED 1 is disposed in the vicinity of the meter in FIG. 1. A fluorescent coating is applied to, or printed onto, the needle indicator portion 2 or the graduated scale portion 3. The needle indicator portion 2 may be made of a synthetic resin or the like, in which the fluorescent substance may be incorporated instead of applied or printed. If the color of the fluorescent coating used on the graduated scale portion is different, then color variations can be provided when the LED emits light. For example, the needle indicator portion 2 may be orange, and the graduated scale portion 3 may be blue.

When the near ultraviolet rays are emitted from the LED 1 in this embodiment, the fluorescent coatings provided in the needle indicator portion 2 and in the graduated scale portion 3 emit light. It thus becomes possible to easily read the meter display, even in a dark location. LED emission angles may differ according to product. For example, when using an LED having a narrow emission angle in a meter having a structure like that of FIG. 2, light can only be emitted to a center portion of the meter, and the fluorescent coating can only partially emit light.

Figure 3:
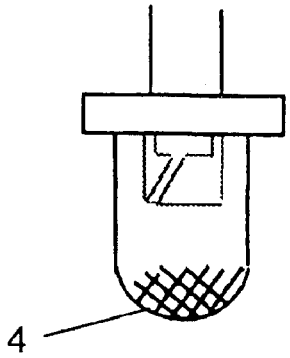
FIG. 3 is an embodiment of an LED having a light diffusing means provided in a lens portion.

An embodiment of an LED having a light diffusing means provided in a lens portion 4 is shown in FIG. 3.

The LED shown in FIG. 3 structures the light diffusing means by finishing a surface of the lens portion 4 in the periphery of an LED lamp in a frosted glass state. It becomes possible to light up the entire meter even if an LED having a narrow emission angle is used, because the surface roughness of the surface is coarse, and light from the lamp is diffused. The light emitting means is not limited to this structure, and a plurality of grooves may also be formed in the surface of the lens.

The light diffusing means can also be provided in the outer circumference of the meter. An embodiment of a meter to which the light diffusing means is provided is shown in FIG. 4.

Figure 4:
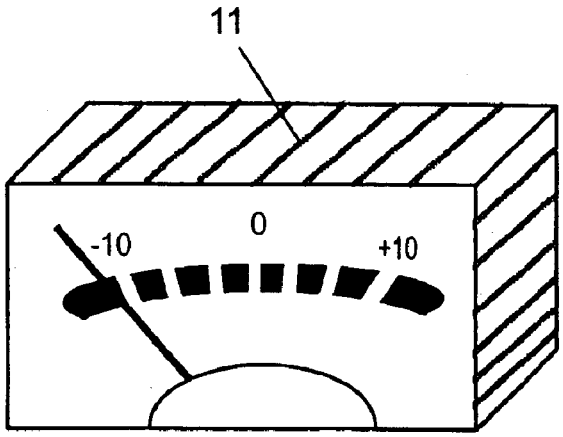
FIG. 4 is an embodiment of a meter to which a light diffusing means is provided.

In FIG. 4, a knurl groove is cut around the entire circumference in a case portion outer circumference 11 of the meter 12. The near ultraviolet rays emitted form the LED 1 are diffused by the knurl groove, and the entire meter is illuminated. The light diffusing means of the meter is not limited to this method. Using frosted glass, or finishing a surface of the light diffusing means into a coarse state, can also be considered, similar to the case of the LED.

Provided that the light diffusing means is used, disposal of the LED 1 need not be in the portion above the center of the meter, as shown in FIG. 2. For example, disposing the LED 1 on a side surface of the meter, or irradiating from a lower surface can also be considered. It thus becomes possible to increase the degree of freedom in designing the tuning device, and miniaturization and cost savings become possible.

With a tuning device according to the present invention, as explained above, visibility can be increased when performing tuning in a dark location by using an LED having energy capable of causing a fluorescent material to emit light, and by using a needle indicator portion or a graduated scale portion to which a fluorescent coating is applied, in a meter. Further, as many variations as the number of fluorescent coatings being used can be made by using a plurality of fluorescent coatings, and visibility effects can be obtained.

What is claimed is:

1. A tuning device for measuring a deviation between a fundamental frequency of one of a sound of a musical instrument and a music signal, and a reference frequency as a standard for comparison, to display the deviation, comprising:

displaying means for displaying the deviation, the displaying means comprising a meter having a needle indicator portion and a graduated scale portion;

illuminating means for illuminating the displaying means, the illuminating means comprising an LED disposed in the vicinity of the displaying means; and a fluorescent coating applied to one of the needle indicator portion and the graduated scale portion.

2. A tuning device according to claim 1; wherein the LED emits energy capable of causing the fluorescent coating to emit light.

3. A tuning device according to claim 1; wherein the LED emits near ultraviolet rays.

4. A tuning device according to claim 1; further including light diffusing means provided in a lens portion of the LED for diffusing light.

5. A tuning device according to claim 1; further including light diffusing means provided in an outer circumference of the meter for diffusing light.

6. A tuning device according to claim 5; wherein the light diffusing means comprises a knurl provided in the outer circumference of the meter.

7. A tuning device for measuring a deviation between a fundamental frequency of one of a sound of a musical instrument and a music signal, and a reference frequency as a standard for comparison, to display the deviation, comprising:

displaying means for displaying the deviation, the displaying means comprising a meter having a needle indicator portion and a graduated scale portion;

illuminating means for illuminating the displaying means, the illuminating means comprising an LED disposed in the vicinity of the displaying means; and a fluorescent substance incorporated in one of the needle indicator portion and the graduated scale portion.

8. A tuning device according to claim 7, wherein the LED emits energy capable of causing the fluorescent material to emit light.

9. A tuning device according to claim 7; wherein the LED emits near ultraviolet rays.

10. A tuning device according to claim 7; further including light diffusing means provided in a lens portion of the LED for diffusing light.

11. A tuning device according to claim 7; further including light diffusing means provided in an outer circumference of the meter for diffusing light.

12. A tuning device according to claim 11; wherein the light diffusing means comprises a knurl provided in the outer circumference of the meter.

13. A tuning device for measuring a deviation between a fundamental frequency of one of a sound of a musical instrument and a music signal, and a reference frequency as a standard for comparison, to display the deviation, comprising:

a meter having a graduated display portion and a needle indicator portion movable relative to the graduated display portion to indicate the deviation, at least one of the graduated display portion and the needle indicator portion being provided with a fluorescent substance; and an LED for emitting energy effective to cause the fluorescent substance to emit light to illuminate the meter.

14. A tuning device according to claim 13; wherein the LED has a lens portion having a coarse surface for diffusing energy emitted by the LED.

15. A tuning device according to claim 13; wherein both of the graduated display portion and the needle indicator portion are provided with a fluorescent substance.

16. A tuning device according to claim 15; wherein the fluorescent substance of the graduated display portion emits light of a different color from that emitted by the fluorescent substance of the needle indicator portion.

17. A tuning device according to claim 16; wherein the LED emits near ultraviolet rays.

18. A tuning device according claim 13; wherein the LED emits near ultraviolet rays.

* * * * *